US007017324B2

(12) United States Patent
Battisti

(10) Patent No.: US 7,017,324 B2
(45) Date of Patent: Mar. 28, 2006

(54) MACHINE FOR PRODUCING STRIP PACKAGES

(75) Inventor: Antonio Battisti, Latina (IT)

(73) Assignee: Packservice S.R.L., Latina (IT)

( * ) Notice: Subject to any disclaimer, the term of this patent is extended or adjusted under 35 U.S.C. 154(b) by 214 days.

(21) Appl. No.: 10/782,222

(22) Filed: Feb. 19, 2004

(65) Prior Publication Data

US 2004/0163359 A1 Aug. 26, 2004

(30) Foreign Application Priority Data

Feb. 20, 2003 (IT) ..... BO2003A0076

(51) Int. Cl.
*B65B 9/20* (2006.01)

(52) U.S. Cl. ..... 53/550; 53/551; 53/541

(58) Field of Classification Search ..... 53/451, 53/550, 551, 541
See application file for complete search history.

(56) References Cited

U.S. PATENT DOCUMENTS 2,744,369 A * 5/1956 Seragnoli ..... 53/541
3,164,935 A 1/1965 Stroop
3,611,671 A 10/1971 Rathbone et al.
4,614,076 A 9/1986 Rathemacher
4,881,360 A * 11/1989 Konzal et al. ..... 53/451
5,031,385 A * 7/1991 Wada ..... 53/551
5,454,208 A * 10/1995 Kawano ..... 53/451
5,938,032 A 8/1999 Carpenter et al.
6,058,680 A * 5/2000 Meli et al. ..... 53/551

FOREIGN PATENT DOCUMENTS

FR 2646140 A 10/1990

* cited by examiner

*Primary Examiner*—John Sipos

(57) ABSTRACT

In a machine for obtaining strip packages a station feeds products to a packaging group, which places and seals each of the products in a relative welded pockets distributed along a continuous strip. In a working station, situated in cascade with the packaging group, a feeler group, a printing group, a working group, a drawing group, a cutting group cooperate to supply at the outlet a plurality of strip packages. The packaging group is arranged in a vertical configuration and the configuration of the working group is horizontal. Direction-changing means make the continuous strip pass from a vertical configuration to a horizontal one.

18 Claims, 6 Drawing Sheets

MACHINE FOR PRODUCING STRIP PACKAGES

FIELD OF THE INVENTION

The present invention relates to automatic packaging of products, in particular tablets, pills, capsules and the like.

In this specific case, the present invention proposes a machine for packaging such products in the so-called strip packages of predetermined dimensions.

BACKGROUND OF THE INVENTION

The strip packages advantageously allow each product to be hermetically sealed. Information concerning the product contained in the strip package can be printed and/or coded on the relative package, such as for example packaging and expiry dates, product composition, dosage and use instruction, etc.

This kind of package is particularly indicated for effervescent products, particularly sensitive to humidity, and generally, for pharmaceutical products.

The strip packages are obtained from two sheets of heat-weldable material, which are placed one over the other, touching each other, and which form a plurality of suitably spaced apart pockets for containing single products.

The pockets are suitably welded along the peripheral edges, so as to make them hermetic and sealed.

Pre-breaking areas, facilitating detaching of the single pocket from the package, are defined by pre-cuts made in regions corresponding to the welded areas comprised between the adjacent pockets of the same longitudinal row, or to an adjacent row.

In accordance with the required specifications, the strip packages can include one single pocket containing the respective product, or a plurality of pockets, usually arranged in one or more longitudinal rows.

Known machines for strip packaging of products extend substantially vertically and, in most cases, they are operated in a continuous operation cycle.

A feeding station is situated in the upper portion of these machines, for feeding products, in a way widely known to those skilled in the art, to a packaging station, situated below, in cascade, where the products are placed and sealed in the respective pockets.

The packaging station includes a pair of counter-rotating welding rolls, having horizontal and parallel axes, touching each other along a common generatrix, and acting together on two sheets of weldable material, which unwind from respective reels, situated opposite to each other and on both sides with respect to the welding rolls.

Each of welding rolls has, on its outer surface, a plurality of axially and angularly equidistant radial recesses, which match corresponding radial recesses of the adjacent roll during the synchronous rotation of the rolls. In this way, a series of cavities are formed for housing the products supplied by the feeding station.

The products are first released and placed in the cavities, where they are covered by sheets, which pass and turn over the welding rolls, to define the containing pockets, which are then welded along the peripheral edges thereof, thus obtaining hermetic and sealed packages.

The peripheral edges of the recesses of each welding roll, in particular of the areas of the outer surfaces comprised between adjacent recesses, are heated by relevant groups of electric heating elements, suitably distributed. The temperature produced by the heating elements is constantly measured by suitably situated thermal probes.

Therefore, a continuous strip of welded pockets is obtained at the outlet of the pair of counter-rotating welding rolls.

The packaging station includes, arranged in cascade with the welding rolls, symmetrically thereto, a pair of lower counter-rotating rolls, having horizontal parallel axes, touching each other along a common generatrix, aimed at drawing the obtained continuous strip away from the packaging station.

Downstream of the packaging station, that is downstream of the pair of lower rolls, there is a working station, which, according to a continuous operation cycle, performs the following operations: ink jet printing on each pocket; codifying obtained by dry-stamping with a die and a relief; checking, by suitable feeler pin means, the presence of the products inside each sealed pocket; precutting, crosswise with respect to the forward movement direction of the strip of welded pockets, by means of pre-cutting groups; longitudinal cutting to obtain longitudinal rows by first cutting groups; crosswise cutting of each longitudinal row by second cutting groups.

The so obtained strip packages, formed by a predetermined number of pockets, are moved along slide conveyors, which, due to gravity, space them apart, in random way, and send them to belt conveyors situated nearby, usually arranged at 90° with respect to the feeding direction of the feeding station.

The main drawback of this type of packaging machines lies in the fact that it is necessary to add an auxiliary machine, positioned in cascade with the described one, for allowing feeding of a packaging machine, which is capable of introducing the so obtained strip packages into cases, usually of paperboard.

This derives from the fact that the packages leaving the working group, suitably printed, verified, codified, pre-cut and cut, are placed, by the slide conveyors, on the belt conveyor in a non-controlled configurations, which is not suitable for direct feeding of a packaging machine.

Another drawback results from the considerable vertical extension of the known machines, which does not allow the operator to see correctly critical areas, such as the printing and die-stamping areas, to verify that the information are well printed on the packages. Another critical area which is not well seen by the operator is the welding rolls inlet area, so that the correct feeding of the products and best positioning of the sheets at the inlet cannot be easily verified.

Conventionally, this drawback is avoided by using a mirror, however, they allow only a non direct visual control, and is not particularly reliable and easy for the operator.

A further drawback of the traditional machines for producing strip packages derives from the fact that, if the feeler means detects an anomaly, selecting means reject the whole transversal row of strip packages.

Consequently, also strip packages which have given positive result from the verify, are rejected together with anomalous packages (caused by lacking of one or more products in the relative cavities) present in the same transversal row, which causes a reduction in the production rate.

SUMMARY OF THE INVENTION

The object of the present invention is to avoid the above mentioned drawbacks by proposing a machine which supplies, at its outlet, strip packages in controlled configuration, so as to allow to feed any packaging machine.

Another object of the present invention is to propose a machine, whose vertical extension is considerably reduced, and which ensures intervention and direct visual control of the machine critical areas for any operator.

A further object of the present invention is to propose a machine, which allows a selective and singularized rejection of only faulty products, and which performs a differentiated rejection of the products in relation to the fault type, thus allowing an increase of the operation cycle productivity.

A still further object of the present invention is to propose a particularly compact machine, which is extremely functional and reliable, and which supplies, at the outlet, strip packages in angular configurations with respect to the packaging group.

The above mentioned objects are obtained, in accordance with the contents of the claims, by a machine for producing strip packages, including:

a feeding station for feeding products to a packaging group, which places and seals each of said products in a relative welded pockets distributed on a continuous strip, which defines corresponding rows, longitudinal and transversal, of said pockets;

at least one group, for printing data and/or codified information on each welded pocket and/or between the adjacent welded pockets;

a working station, situated in cascade with said packaging group and aimed at supplying to the outlet section a plurality of strip packages, said working station including:

at least one feeler group for verifying the presence of an product in each corresponding pocket; at least one working group for longitudinal precutting and/or cutting of the continuous strip in the portions comprised between adjacent longitudinal rows;

at least one drawing group for moving forward the continuous strip of welded pockets;

at least one cutting group, for transversal cutting the continuous strip in the portions comprised between the adjacent transversal rows;

with said packaging group arranged in a substantially vertical configuration; and including direction-changing means for making said continuous strip pass from a substantially vertical configuration, at the outlet of said packaging group, to a substantially horizontal configuration, at the inlet of said working station.

BRIEF DESCRIPTION OF THE CLAIMS

The characteristic features of the present invention will be pointed out in the following description of some preferred with reference to the enclosed drawings, in which:

FIGS. 1, 2, 3 are schematic lateral, top and front views of the machine proposed by the present invention, according to a particular embodiment;

FIG. 1*a* is a schematic, enlarged lateral view of the proposed machine, in which the path followed by the continuous strip of welded pockets is pointed out;

DISCLOSURE OF THE PREFERRED EMBODIMENTS

Figure 1:
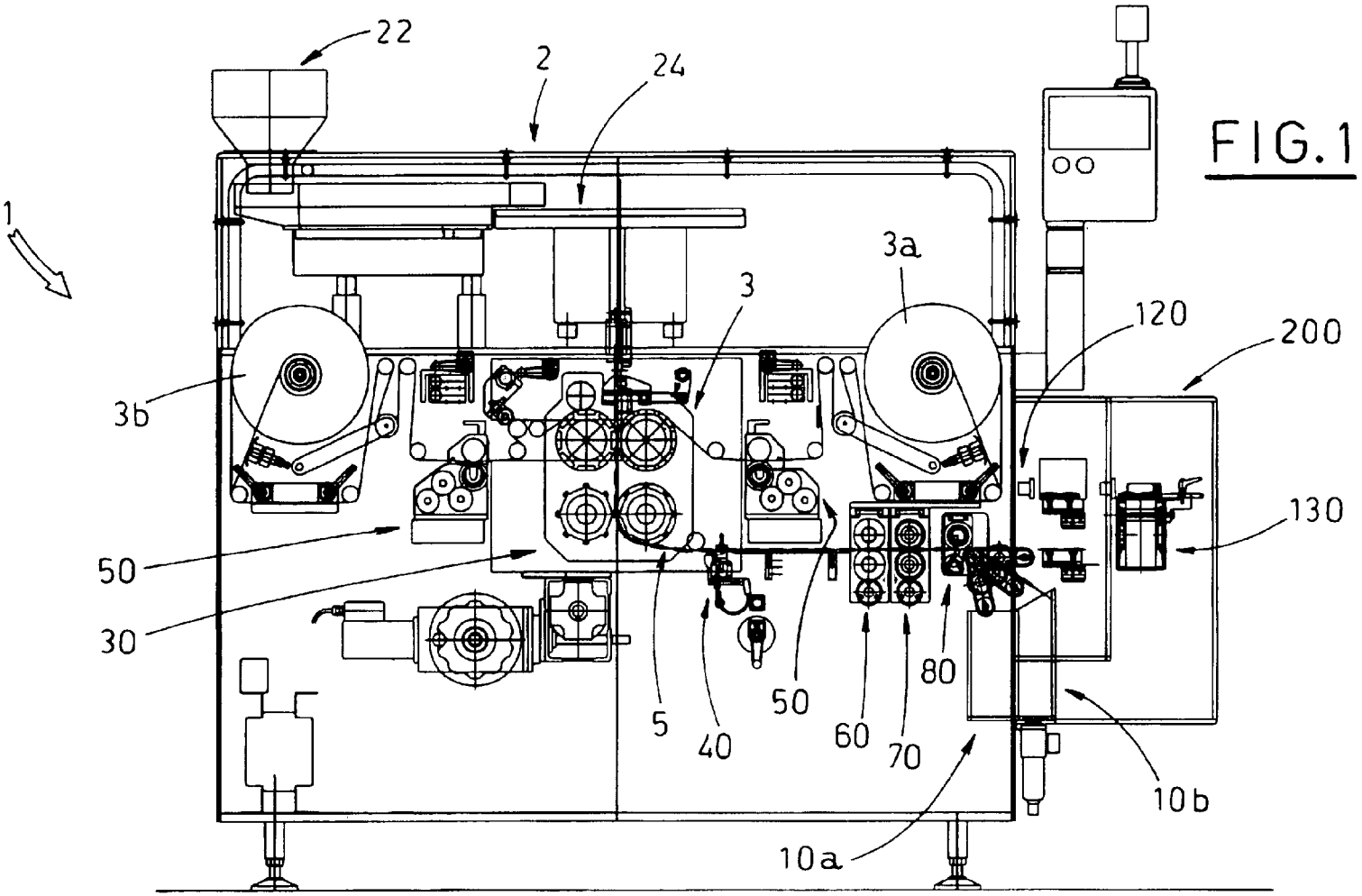

With reference to the above figures, the reference numeral 1 indicates the proposed machine for obtaining strip packages 17, which includes substantially a station 2 for feeding products, in particular tablets, pills, capsules, for example effervescent, to a packaging group 3, arranged in cascade, which places and seals each product in a relative welded pocket, according to techniques widely known to those skilled in the art.

Therefore, a continuous strip 5 of welded pockets, regularly spaced apart and forming corresponding longitudinal and transversal rows, is defined at the outlet of the packaging group 3.

The feeding station 2 includes, for example, two separate sections working in parallel, respectively for feeding effervescent tablets and for feeding other pharmaceutical products.

With reference to FIG. 1, the feeding station 2 includes, for example, a hopper 22 communicating with selecting means 24 for feeding the above products to the packaging group 3.

According to known configurations, the packaging group 3, oriented with substantially vertical extension, includes a pair of counter-rotating welding rolls 31, 32, having horizontal and parallel axes, touching each other along a common generatrix, and acting together on two sheets of weldable material.

The sheets of weldable material are drawn from respective reels 3*a*, 3*b*, situated opposite to each other and at both sides of the welding rolls 31, 32.

As shown in FIG. 1, a pair of printing groups 50, facing each other, act on the relative sheet of weldable material, drawn from the respective reels 3*a*, 3*b*, before they reach the packaging group 3.

The groups 50, capable of printing codified data and/or information (expiry and/or packaging date, lot number, etc.) on each welded pocket and/or between adjacent welded pockets, can be either ink-applied rolls, which print by a plate (clichè) or with characters, or ink-jet printer.

As it has been anticipated, each welding roll 31, 32 has on its outer surface a plurality of radial recesses, regularly spaced apart axially and angularly, which face corresponding radial recesses of the adjacent welding roll during the synchronous movement of the welding rolls. In this way, a series of cavities are formed for housing the products released by the feeding station 2.

The products released are then placed in the cavities, where they are covered by the sheets, which adhere to the welding rolls 31, 32, to define the containing pockets.

The two sheets are welded in the regions corresponding to the portions of the outer surface of the welding roll 31, 32, which are suitably knurled, comprised between adjacent cavities, along the peripheral edges thereof, thus obtaining hermetic and sealed pockets.

Advantageously, the peripheral edges of the recesses of each welding roll 31, 32, are heated by groups of electric heating elements, suitably distributed. The temperature determined by each welding roll 31, 32 is constantly measured by suitably situated thermal probes.

The heating elements and thermal probes have not been shown, as widely known to those skilled in the art.

The proposed machine 1 includes, arranged in cascade with the packaging group 3, a pre-breaking group 30, which precuts crosswise the continuous strip 5 of welded pockets in the portions comprised between adjacent transversal rows.

The pre-breaking group 30 includes a pair of counter-rotating pre-breaking rolls 33, 34, having parallel axes, touching each other along a common generatrix line.

The outer surfaces of the pre-breaking rolls have cutting means, which precut the continuous strip 5 between adjacent transversal rows of welded pockets.

The continuous strip 5 of welded pockets, precut crosswise at the outlet of the pre-breaking rolls 33, 34, is placed on a superficial portion 99 of one of the rollers, and is conveyed thereby to swerve so as to change the forward direction and the configuration from substantially vertical, while passing through the welding rolls 31, 32 and the pre-breaking rolls 33, 34, to a substantially horizontal, downstream of the pre-breaking rolls 33, 34.

A plurality of groups 40, 50, 60, 70, 80 are situated in cascade with the transversal precut group 30, in a substantially horizontal arrangement, aimed at supplying at the outlet a plurality of strip packages 17 of prefixed longitudinal and transversal size.

By way of example, downstream of the first group 30, there: a feeler group 40, for verifying the presence of an product inside the pockets; a working group 60 for longitudinal precutting and cutting of the continuous strip 5 in the portions comprised between the adjacent longitudinal rows; a drawing group 70 for driving the continuous strip 5 of welded pockets; a cutting group 80, for example rotating, for transversal cutting the continuous strip 5 in the portions comprised between the adjacent transversal rows.

Downstream of the cutting group 80, the machine 1 supplies at the outlet a plurality of strip packages 17 of prefixed longitudinal and transversal size.

The feeler group 40, working group 60 and cutting group 80, arranged horizontally, as well as the packaging group 3 and the pre-breaking group 30, arranged vertically, together with the printing groups 50, are all operated continuously and in step relation with the drawing group 70.

Selecting means 90 are situated downstream of the cutting group 80 and are aimed at receiving the strip packages 17 leaving the cutting group 80 and at conveying them, if a fault is detected, to suitable collecting sections (10*a*, 10*b*) situated at a lower level, or to a terminal section 100, substantially coplanar with the cutting group 80, if verified integral.

The selecting means 90 can include for example a plurality of selecting belts 91, each of which is associated to a corresponding longitudinal row of the continuous strip 5, and is capable of accelerating the strip packages 17 coming from the cutting group 80, thus spacing them apart.

The selecting belts 91, preferably endless, mounted around corresponding driving and driven wheels, are operated in step relation with the cutting group 80 and moved in variable inclination by corresponding motor means, of known type and thus not shown.

A first series of strip packages 17 detected as faulty (for example because of the lacking of the product in each welded pocket) is sent to the first collection section 10*a*, while a second series of strip packages 17 detected as faulty (for example due to the lack of one or more products, or due to the presence of damaged and/or split products in one or more welded pockets), is sent to a second collection section 10*b*.

A terminal group 200 is situated in a position corresponding to the terminal section 100 for supplying, at the outlet, strip packages 17 in controlled configuration, particularly useful in case of feeding a packaging machine arranged in cascade.

The terminal group 200 includes raising means 110, which receive, from the corresponding selecting belts 91, the strip packages 17, detected as integral, and which move vertically from a lowered position A, in which they are substantially coplanar with the terminal section 100, to a raised position B, in which they are brought to a higher level, in a position corresponding to an outlet section 101.

The raising means 110 include a transversal plate 111, operated in step relation with the selecting belts 91, and supporting a plurality of longitudinal plates 112, each of which is associated to a relative longitudinal row of the continuous strip 5, and featuring means 112*a* for gripping the strip packages 17, which are to be brought by the longitudinal plates 112.

The terminal group 200 includes at least one collection magazine 102, connected to each longitudinal plate 112 and aimed at receiving a prefixed number of strip packages 17, detected as integral, to form relative piles 17*a*.

Figure 6:
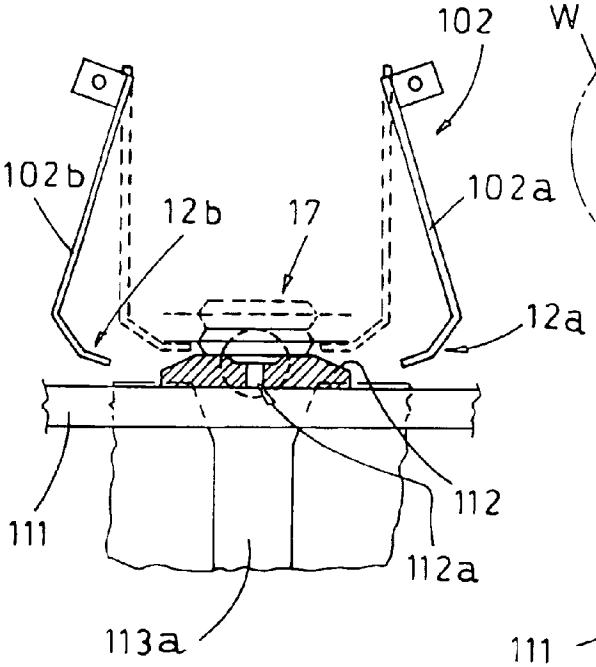
FIG. 6 is a schematic, particularly enlarged view of the detail W shown in FIG. 5.

With reference to FIG. 6, it is seen that each collection magazine 102 is formed, for example, by lateral walls (102*a*, 102*b*), whose lower parts feature corresponding horizontal teeth 12*a*, 12*b* and which swing in step relation with the operation of the longitudinal plates 112, so as to increase the inlet section of the open bottom 103 and to allow the strip packages 17 carried by the longitudinal plates 112 to be introduced from the bottom.

When the products 17 have been introduced, the lateral walls 102*a*, 102*b* return to a substantially parallel configuration, so that the piles 17*a* of the strip packages 17 present in the collection magazines 102 can be supported by the horizontal teeth 12*a*, 12*b*.

During the passage between the terminal section 100 and the outlet section 101, each longitudinal plate 112 cooperates with corresponding guiding means 113, preferably linear cam grooves, which can change uniformly the distances between the plates 112, in the beginning defined by the distance between the selecting belts 91, to make them match the distances between the collecting magazines 102.

In the outlet section 101, the terminal group includes pushing means 120, operated in step relation with the movement of the longitudinal plates 112 and aimed at conveying the strip packages 17, piled up in the collecting magazines 102, into the relative calibrated seats 131 made in an adjacent transferring line 130, arranged for example in a so-called "90°" configuration.

Thus, the pushing means 120 convey the strip packages 17 piled up in the corresponding calibrated seats 131 in step relation with the operation of the transferring line 130, so as to allow feeding of a packaging machine (not shown).

Advantageously, the distances between the the collecting magazines 102 are variable and are substantially equal to the corresponding distances between the calibrated seats 131 made in the transferring line 130.

The feeding station 2 and the packaging group 3 are situated in a first section of the machine, characterized by a substantially vertical extension, while the feeler group 40, the working group 60, the drawing group 70, the cutting group 80 and the selecting means 90, as well as the terminal group 200 are situated in a second section of the machine, arranged in cascade to the first section, characterized by a substantially horizontal extension.

The printing groups 50 can be situated either in the first, vertical section of the machine, or the in the second, horizontal section.

Figure 1A:
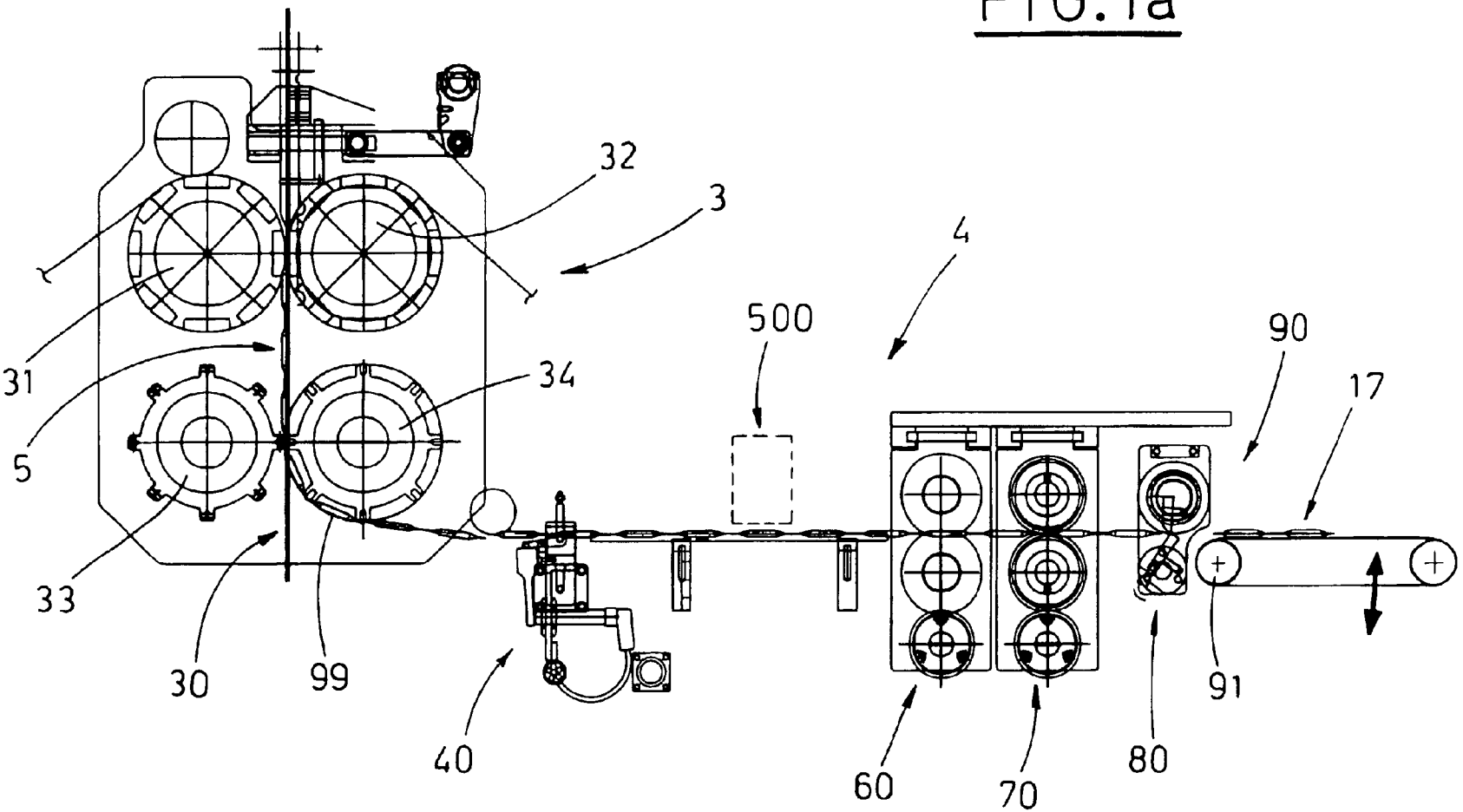
Figure 2:
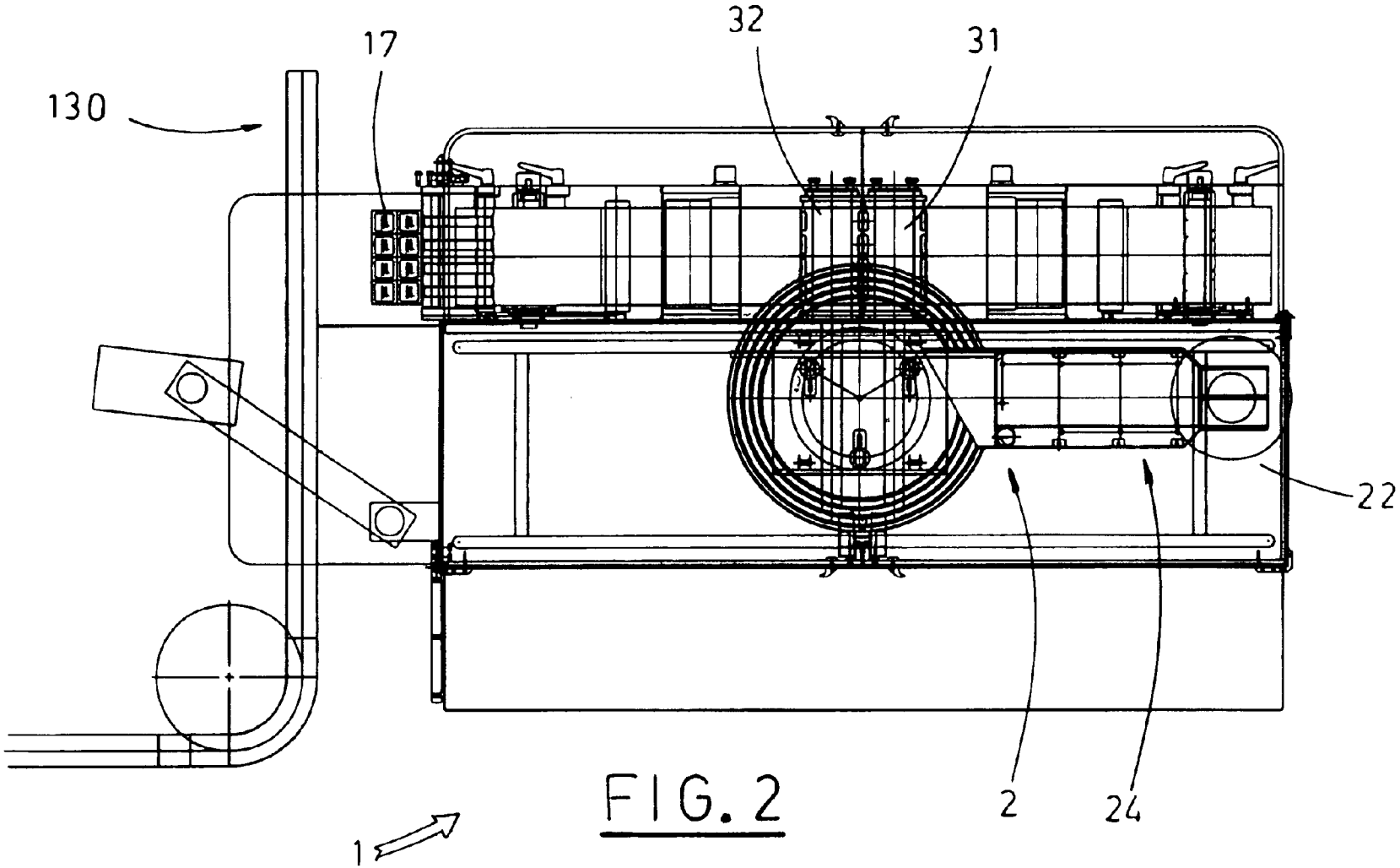
Figure 3:
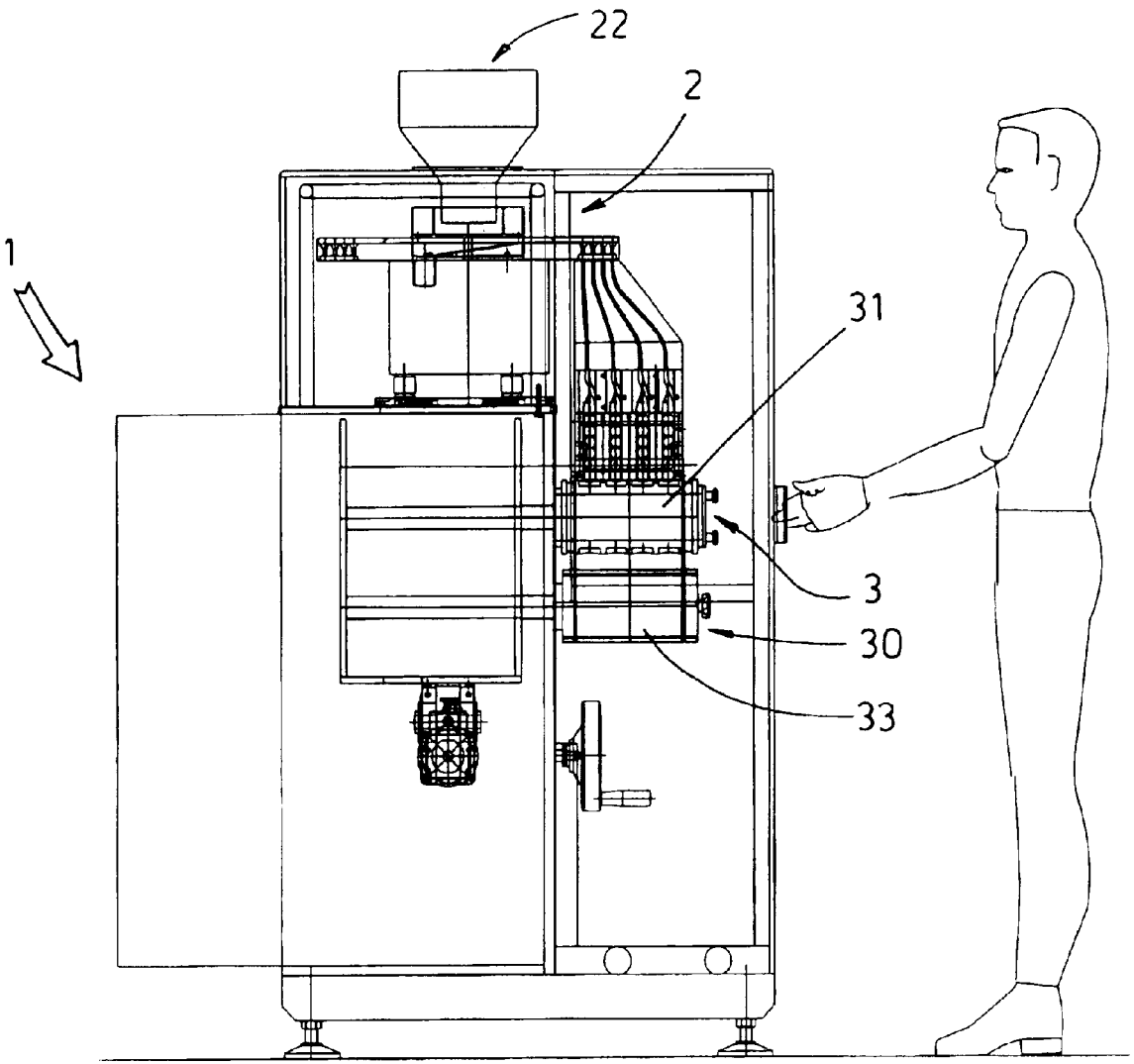
Figure 4:
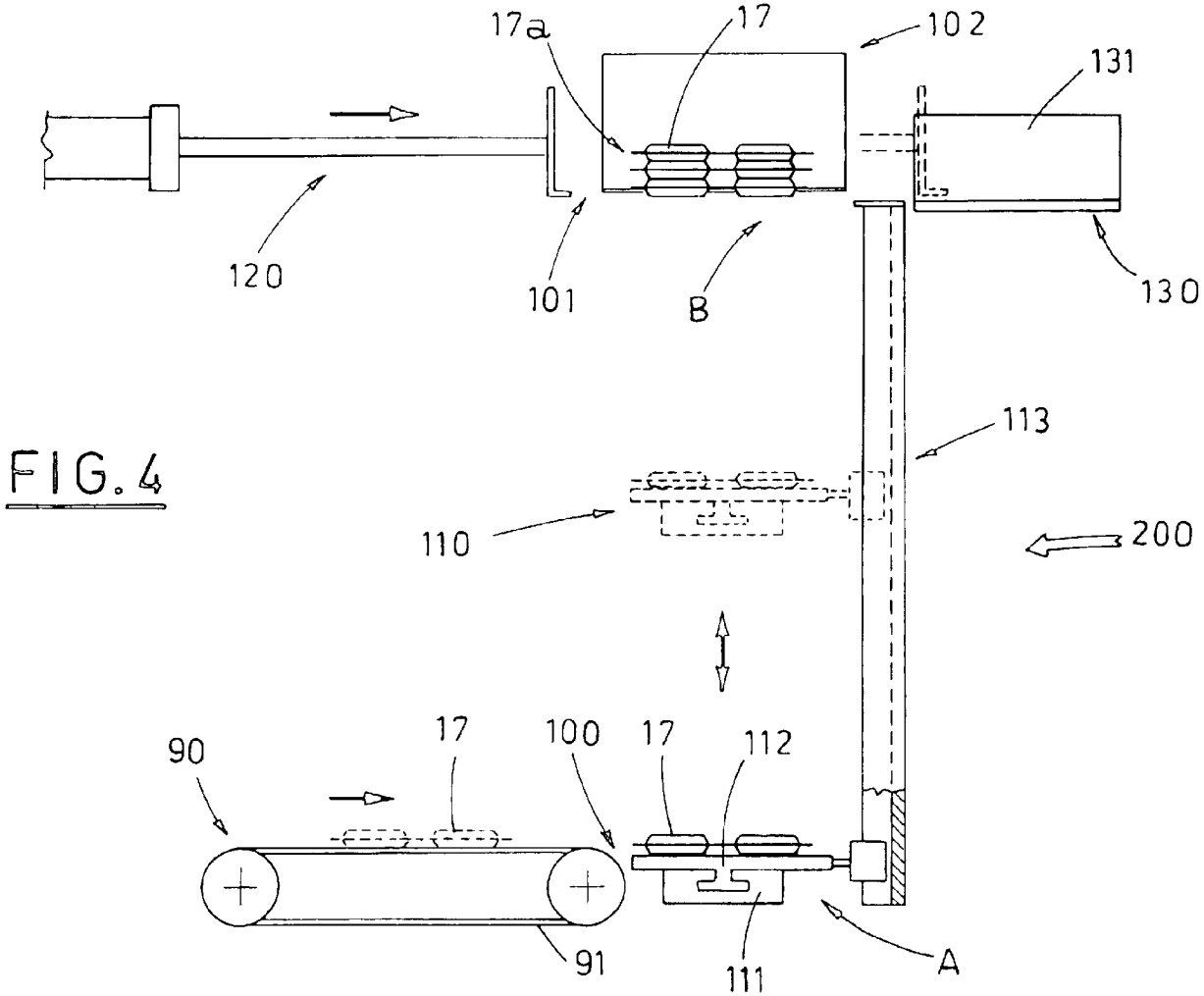
FIGS. 4, 5 are schematic, enlarged, respectively lateral and front views of the outlet section of the proposed machine during the transferring of the strip packages onto a conveying line, arranged at 90°.
Figure 5:
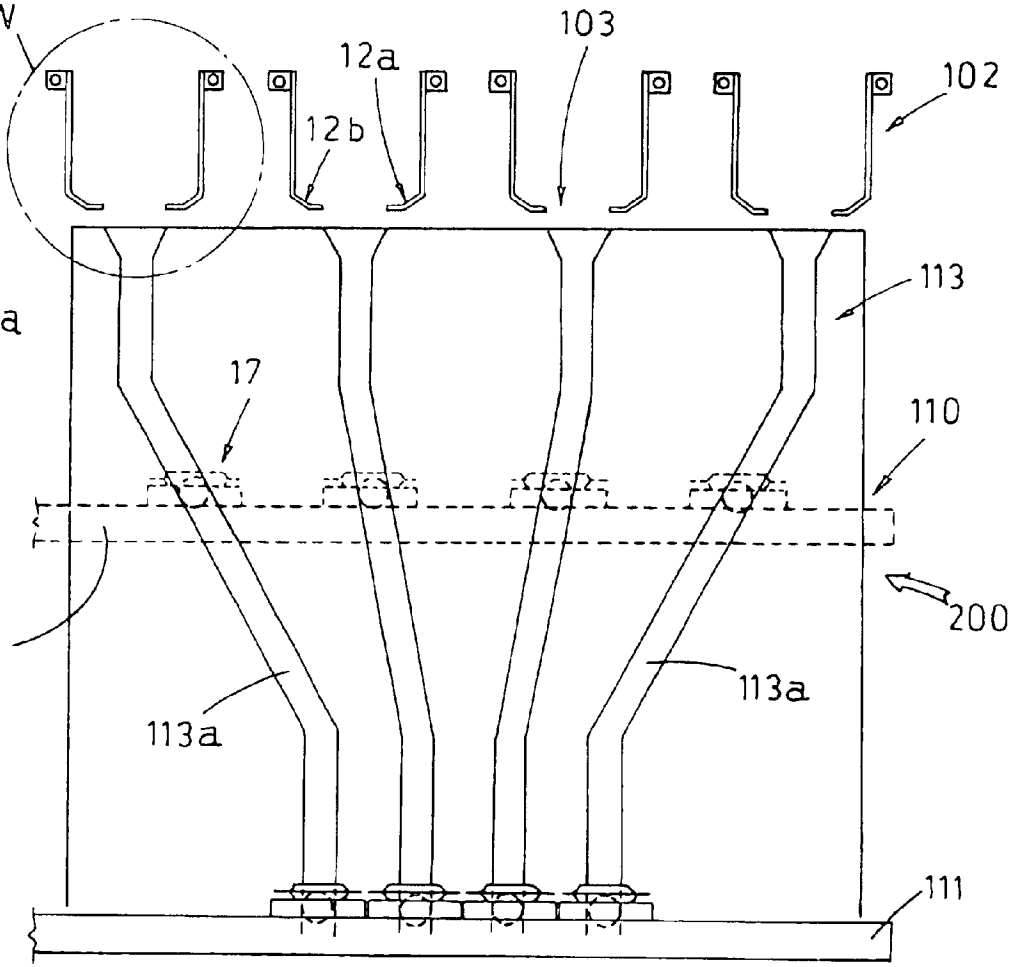

According to an interesting embodiment, there can be only one printing group 500 (indicated with broken line in FIG. 1*a*), situated downstream of the feeler group 40, so as not to influence the machine vertical extension, and acting directly on the continuous strip 5 of welded pockets.

The transferring line 130 can be oriented, in relation to the machine outlet, longitudinally (in line configuration) or transversely (90° configuration) with respect to the direction of the selecting means 90 movement.

According to interesting embodiments, the proposed machine 1 can have no terminal group 200, so as to allow the best use flexibility, although the strip packages 17 do not leave in controlled configuration.

Actually, if there is no terminal group 200, the strip packages 17 leaving the cutting group 80 are picked up by the selecting belts 91, which can slope down and reject packages, that is they can release them toward the collecting sections 10*a*, 10*b*, or they can convey the strip packages 17 to the terminal section 100. In this last case, the terminal section 100 coincides with the outlet section, from which the packages are withdrawn in a known way.

According to other embodiments, the proposed machine 1 can have no collecting sections 10*a*, 10*b*, so as to prevent rejection of faulty strip packages 17.

The proposed machine 1 for producing strip packages 17, with respect to prior art, allows the release of the strip packages 17 in a controlled configuration, in particular into relative calibrated seats 131 made in the transferring line 130, independently from the arrangement of the latter (in line or at 90°); this allows feeding directly a packaging machine without interposing any type of apparatus.

According to the vertical motion extension of the longitudinal plates 112, the machine 1 adapts to different height of the calibrated seats 131, made in the transferring line 130, used each time.

The vertical extension of the machine 1 is particularly reduced, substantially defined by the cascade of the feeding group and of pre-breaking group, and this allows any operator to directly control visually the critical areas of the machine, such as feeler groups 40, printing groups 50, working group 60, drawing group 70, cutting group 80 and the selecting means 90, as well as the terminal group 200, thus allowing rapid interventions.

According to the shown embodiment, the pre-breaking group 30 is used for changing the forward direction of the continuous strip 5 from a vertical configuration into a horizontal one, but it can be advantageously substituted by any direction-changing means, which can perform the same operations.

In this case, the pre-breaking group 30 is included in the working station.

Moreover, the reduced vertical dimensions allow to obtain a very compact machine 1, object of the present invention.

The possibility of a selective and singularized rejection of only faulty products is particularly interesting, because it allows rejection of the products in accordance with the fault kind, which results in the increase of the operation cycle productivity.

It is to be pointed out that the proposed machine 1 is particularly compact, extremely functional and reliable, and it is capable of supplying, at the outlet, the strip packages 17 arranged angularly in line or at 90° with respect to the selective belts 91.

What is claimed is:

1. A machine for producing strip packages, including:

a feeding station for feeding products to a packaging group, which places and seals each of said products in a relative welded pockets distributed on a continuous strip, which defines corresponding rows, longitudinal and transversal, of said pockets;

at least one group, for printing data and/or codified information on each welded pocket and/or between the adjacent welded pockets;

a working station, situated in cascade with said packaging group and aimed at supplying to an outlet section a plurality of strip packages, said working station including:

at least one feeler group for verifying the presence of an product in each corresponding pocket; at least one working group for longitudinal precutting and/or cutting of the continuous strip in the portions comprised between adjacent longitudinal rows;

at least one drawing group for moving forward the continuous strip of welded pockets;

at least one cutting group, for transversal cutting the continuous strip in the portions comprised between the adjacent transversal rows;

with said packaging group arranged in a substantially vertical configuration; and including direction-changing means for making said continuous strip pass from a substantially vertical configuration, at the outlet of said packaging group, to a substantially horizontal configuration, at the inlet of said working station.

2. A machine according to claim 1, further including, situated is said working station, at least one pre-breaking group aimed at transversal precutting of said continuous strip in portions comprised between adjacent transversal rows of welded pockets.

3. A machine according to claim 2, wherein said pre-breaking group includes at least one pair of counter-rotating pre-breaking rolls, having horizontal and parallel axes, touching each other along a common generatrix, the outer surfaces of said pre-breaking rolls having cutting means, capable of precutting between adjacent transversal rows of welded pockets of said continuous strip.

4. A machine according to claim 1, wherein said direction-changing means include a pre-breaking group, situated below said packaging group and aimed also at transversal precutting the continuous strip in portions comprised between adjacent transversal rows of welded pockets; said pre-breaking group being capable of changing the forward direction of the continuous strip from a substantially vertical configuration to a substantially horizontal configuration.

5. A machine according to claim 4, wherein said pre-breaking group includes at least one pair of counter-rotating pre-breaking rolls, having horizontal and parallel axes, touching each other along a common generatrix, the outer surfaces of said pre-breaking rolls having cutting means, capable of precutting between adjacent transversal rows of welded pockets of said continuous strip.

6. A machine according to claim 1, further including a first machine section, substantially vertical, including at least said feeding station and said packaging group, and a second machine section, substantially horizontal, including at least said working station.

7. A machine according to claim 1, further including selecting means, arranged in cascade after said cutting group, operated in step relation with the latter and aimed at conveying strip packages, leaving said working group, to said outlet section.

8. A machine according to claim 7, further including a plurality of collecting sections situated near said cutting group and at a lower level with respect to said selecting means, for receiving strip packages detected as faulty by said feeler group and released by said selecting means; said selecting means being operated to slope vertically.

9. A machine according to claim 8, further including, arranged in cascade after said selecting means, a terminal group, which supplies, at the outlet, strip packages in controlled configuration to a transferring line to feed a packaging machine.

10. A machine according to claim 9, wherein said terminal group includes:

raising means, aimed at receiving strip packages from said selecting means, operated in step relation with the latter, and moving vertically from a lowered position, in which they are substantially coplanar with said terminal section, to a raised position, in which they are situated near an outlet section, substantially coplanar with said transferring line;

a plurality of collecting magazines, situated in said outlet section, each of which is associated to a corresponding longitudinal row of said continuous strip, and which are aimed at receiving strip packages carried by said raising means, in order to form corresponding piles;

guiding means, cooperating with said raising means, aimed at changing the distances between the latter during the transition from said lowered position, in which said distances are defined by said selecting means, to said raised position, in which the distances is set to match the spacing apart of said collecting magazines;

pusher means, situated in said outlet section, operated in step relation with said raising means to convey said strip packages situated in each of said collecting magazines to relative seats made in said transferring line.

11. A machine according to claim 10, wherein said raising means include at least one transversal plate, operated in step relation with said selecting means, and moving between said terminal section and outlet section, with a plurality of longitudinal plates supported by said transversal plate, each of the longitudinal plates being associated to a corresponding longitudinal row of said continuous strip and equipped with gripping means, which are operated in step relation with the operation of said transversal plate to stabilize said strip packages supported by the longitudinal plate.

12. A machine according to claim 11, wherein said guiding means, cooperating with said raising means, include a plurality of linear cam grooves, each of which interacts with a corresponding longitudinal plate during the movement of the latter between said lowered position and raised position.

13. A machine according to claim 11, wherein each of said collecting magazines includes relative lateral walls, whose lower parts include corresponding horizontal teeth, aimed at being inclined, in step relation with the movement of said longitudinal plates, so as to change the inlet section of the corresponding open bottom, increasing it, and to allow the strip packages carried by said longitudinal plates, to be introduced from the bottom, so as to define the above piles of strip packages inside said collecting magazine, and in that said horizontal teeth, when in configuration substantially parallel to said lateral walls (102*a*, 102*b*), support said piles (17*a*) of strip packages.

14. A machine according to claim 13, wherein said transferring line is arranged angularly with respect to said selecting means.

15. A machine according to claim 14, wherein said transferring line is arranged longitudinally, or transversely with respect to said selecting means.

16. A machine according to claim 15, wherein said selecting means include a plurality of selecting belts, which are operated in step relation with said cutting group, and each of which is associated to a corresponding longitudinal row of said continuous strip, and able to accelerate the strip packages coming from said cutting group.

17. A machine according to claim 16, wherein said selecting belts are endless and wind on corresponding driving and driven wheels.

18. A machine according to claim 1, wherein said continuous strip of welded pockets is moved continuously by said drawing group.

* * * * *